US012653251B2

(12) United States Patent
Dierkes

(10) Patent No.: US 12,653,251 B2
(45) Date of Patent: Jun. 16, 2026

(54) SPORTS UPPER BODY PROTECTIVE GEAR

(71) Applicant: Wilson Sporting Goods Co., Chicago, IL (US)

(72) Inventor: Matthew J. Dierkes, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 768 days.

(21) Appl. No.: 17/498,936

(22) Filed: Oct. 12, 2021

(65) Prior Publication Data

US 2023/0110515 A1 Apr. 13, 2023

(51) Int. Cl.
*A41D 13/05* (2006.01)
*A63B 71/12* (2006.01)

(52) U.S. Cl.
CPC ..... *A41D 13/0512* (2013.01); *A41D 13/0518* (2013.01); *A41D 13/0575* (2013.01); *A63B 2071/1208* (2013.01)

(58) Field of Classification Search
CPC ..... A41D 13/0518; A41D 13/0512; A41D 13/0575; A63B 2071/1208
See application file for complete search history.

(56) References Cited

U.S. PATENT DOCUMENTS 2,309,476 A 1/1943 Patterson, Jr.
3,557,156 A 1/1971 Enneper et al.
3,890,649 A 6/1975 Diggins
3,900,024 A 8/1975 Lauber et al.
3,923,049 A 12/1975 Lauber et al.
4,051,553 A 10/1977 Howard
4,235,228 A 11/1980 Gaylord et al.
4,279,344 A 7/1981 Holloway, Jr.
4,295,229 A 10/1981 Clark et al.
4,301,564 A 11/1981 Dalebout
4,400,829 A 8/1983 Willis
4,411,262 A 10/1983 von Bonin et al.
4,427,002 A 1/1984 Baron et al.
4,428,089 A 1/1984 Dawber et al.
4,433,494 A 2/1984 Courvoisier et al.
4,433,680 A 2/1984 Yoon
4,442,833 A 4/1984 Dahlen et al.
4,484,360 A 11/1984 Leighton et al.
4,502,479 A 3/1985 Garwood et al.
4,559,646 A 12/1985 Ertl
4,570,622 A 2/1986 von Bonin et al.
4,572,171 A 2/1986 Wegner et al.
4,598,429 A 7/1986 Mulvaney
4,676,861 A 6/1987 Bishop
4,690,932 A 9/1987 Mulvaney
4,701,963 A 10/1987 Overton
(Continued)

FOREIGN PATENT DOCUMENTS

GB 2055582 3/1981
GB 2200286 8/1988

*Primary Examiner* — Khoa D Huynh
*Assistant Examiner* — Giao Qt Hoang
(74) *Attorney, Agent, or Firm* — Terence P. O'Brien; Todd A. Rathe

(57) ABSTRACT

A sports upper body protective gear may include a padded chest portion to extend over a chest of a sport participant and shoulder portions extending from the padded chest portion over shoulders of the sport participant. Each of the shoulder portions may include a shoulder pocket to removably receive a moldable and hardenable protective insert panel.

21 Claims, 10 Drawing Sheets

(56) References Cited

U.S. PATENT DOCUMENTS 4,770,299 A 9/1988 Parker
4,832,010 A 5/1989 Lerman
4,837,884 A 6/1989 Hilgarth
4,843,651 A 7/1989 Gramza et al.
4,864,660 A 9/1989 Sawyer
4,869,046 A 9/1989 Parker
4,964,229 A 10/1990 Laberge
4,966,134 A 10/1990 Brewer
5,003,970 A 4/1991 Parker et al.
5,027,803 A 7/1991 Scholz et al.
5,060,314 A * 10/1991 Lewis ..... A62B 17/003 2/2.5
5,117,509 A 6/1992 Bowers
D327,754 S 7/1992 Hochgesang et al.
5,183,263 A 2/1993 Kuebler
5,295,269 A 3/1994 Ballard
5,316,294 A 5/1994 Turangan
5,335,916 A 8/1994 Nee
5,364,580 A 11/1994 Prent
5,425,701 A 6/1995 Oster et al.
5,480,376 A 1/1996 Duback et al.
5,511,248 A 4/1996 Widdemer
5,517,694 A 5/1996 Fabry
5,537,692 A 7/1996 Dorr
5,544,663 A 8/1996 Duback
5,598,582 A 2/1997 Andrews et al.
5,608,912 A 3/1997 Cumberland
5,636,381 A 6/1997 Brogden
5,637,077 A 6/1997 Parker
5,665,056 A 9/1997 Nakasugi et al.
5,692,242 A 12/1997 Tekerman et al.
5,708,979 A 1/1998 Redwood et al.
5,727,257 A 3/1998 Chen
5,732,713 A 3/1998 Duback et al.
5,745,919 A 5/1998 Kraatz
5,755,678 A 5/1998 Parker et al.
5,802,614 A 9/1998 Melone, Jr.
5,806,091 A 9/1998 McHugh
5,833,637 A 11/1998 Pong
5,867,830 A 2/1999 Chen
5,957,871 A 9/1999 Darcey
5,980,474 A 11/1999 Darcey
6,006,358 A 12/1999 Keating
6,022,331 A 2/2000 Darcey
6,044,494 A 4/2000 Kang
6,049,910 A 4/2000 McCarter
6,052,827 A 4/2000 Widdemer
6,065,155 A 5/2000 Sandusky
6,105,162 A 8/2000 Douglas
6,128,777 A 10/2000 Foreman
6,182,293 B1 2/2001 Mustin
6,185,747 B1 2/2001 Hughes
6,223,353 B1 5/2001 Ardieri, Jr.
6,253,382 B1 7/2001 Kleinert
6,408,442 B1 6/2002 Kang
6,457,181 B1 10/2002 Grundy
6,526,593 B2 3/2003 Sajovic
6,539,550 B1 4/2003 Flores
6,745,402 B2 6/2004 Caswell
6,745,403 B2 6/2004 Sajovic
6,912,731 B2 7/2005 Cass
6,964,063 B2 11/2005 Bamber
7,210,172 B2 5/2007 Adams, Jr.
7,293,296 B1 11/2007 Beraznik et al.
7,487,553 B2 2/2009 Price
7,669,251 B2 3/2010 Hammons et al.
7,966,670 B2 6/2011 Wilbert et al.
8,015,621 B2 9/2011 Udelhofen
8,191,174 B2 6/2012 Winningham et al.
8,225,426 B2 7/2012 Bevier
8,225,427 B2 7/2012 Bevier
8,239,969 B2 8/2012 Fisher
8,241,705 B2 8/2012 Sha
8,256,028 B1 9/2012 Ibon et al.
8,266,719 B2 9/2012 Duby
9,198,474 B1 12/2015 Hacobian
10,004,975 B2 6/2018 Clement
11,058,940 B2 7/2021 Gilday et al.
2003/0037364 A1 2/2003 Alber
2004/0025226 A1 2/2004 Jaeger
2004/0045074 A1 3/2004 Tremblay
2004/0060097 A1 4/2004 Bamber
2004/0068777 A1 4/2004 Wheelington, II
2004/0107476 A1 6/2004 Goldwitz
2005/0034213 A1 2/2005 Bamber
2007/0174948 A1 8/2007 Robba
2007/0209097 A1 9/2007 Iacullo
2008/0010719 A1 1/2008 Hoelscher
2008/0229477 A1 9/2008 McGrough
2008/0271224 A1 11/2008 Wilbert et al.
2008/0313793 A1* 12/2008 Skottheim ..... A41D 13/0531 2/463
2009/0077706 A1 3/2009 Prather
2009/0139007 A1 6/2009 Bevier
2009/0139010 A1 6/2009 Bevier
2009/0282595 A1* 11/2009 Branson ..... F41H 1/02 2/2.5
2010/0024095 A1 2/2010 Gellis
2010/0077526 A1 4/2010 Smeltzer
2010/0077532 A1 4/2010 Kettani
2010/0077533 A1 4/2010 Munda
2010/0095428 A1 4/2010 Fisher
2010/0186140 A1 7/2010 Ramirez
2010/0325777 A1 12/2010 Radakrishnan et al.
2011/0041235 A1 2/2011 Harris
2011/0113521 A1 5/2011 Bradford
2011/0167548 A1* 7/2011 Jourde ..... A41D 13/0518 2/463
2011/0214220 A1 9/2011 Parker
2011/0214221 A1 9/2011 Munda
2011/0258754 A1 10/2011 DuPont
2011/0296582 A1 12/2011 Bevier et al.
2012/0005580 A1 1/2012 Bevier et al.
2012/0011633 A1 1/2012 Van Hale
2012/0028738 A1 2/2012 Love
2012/0030855 A1 2/2012 Clark
2012/0030856 A1 2/2012 Bevier
2012/0042438 A1 2/2012 Ramirez
2012/0073029 A1 3/2012 Clark
2012/0079647 A1* 4/2012 Doherty ..... A41D 13/015 2/463
2012/0159681 A1 6/2012 Gibby
2012/0204319 A1 8/2012 Gambordella
2012/0227155 A1 9/2012 Brown
2012/0227158 A1 9/2012 Ashworth et al.
2012/0245503 A1 9/2012 DeVries
2012/0324623 A1 12/2012 Cabauy et al.
2013/0036523 A1 2/2013 Webster
2013/0061369 A1 3/2013 Lim
2013/0167281 A1 7/2013 Jennings
2013/0198920 A1 8/2013 Wittman
2013/0227755 A1 9/2013 Bisaillon
2013/0239291 A1 9/2013 Harris
2013/0283498 A1 10/2013 Hewitt
2015/0165302 A1 6/2015 Jaramillo et al.
2015/0314189 A1 11/2015 Le
2016/0367881 A1 12/2016 Le
2017/0160058 A1* 6/2017 Limpisvasti ..... F41H 1/02
2017/0282048 A1 10/2017 Wittman
2017/0291098 A1* 10/2017 Farris ..... A41D 13/0556
2018/0193718 A1 7/2018 Gilday et al.
2018/0255849 A1 9/2018 Paquette et al.
2019/0104778 A1* 4/2019 Giannacco ..... F41H 1/02
2020/0037680 A1* 2/2020 Person ..... A41D 13/0518
2020/0405320 A1 12/2020 Kawamoto
2021/0007873 A1 1/2021 Frederick
2021/0052968 A1 2/2021 Ciaglia
2021/0378332 A1 12/2021 Tryner et al.
2022/0088464 A1 3/2022 Kawiya
2022/0212087 A1 7/2022 Kucharsky

* cited by examiner

SPORTS UPPER BODY PROTECTIVE GEAR

BACKGROUND

Participants and officials in various sport activities often wear upper body protective gear. For example, participants in football and lacrosse frequently wear upper body protective gear that protects both the chest and shoulders of the sports participant. Baseball and softball catchers, as well home plate umpires, frequently wear chest protectors.

Figure 1:
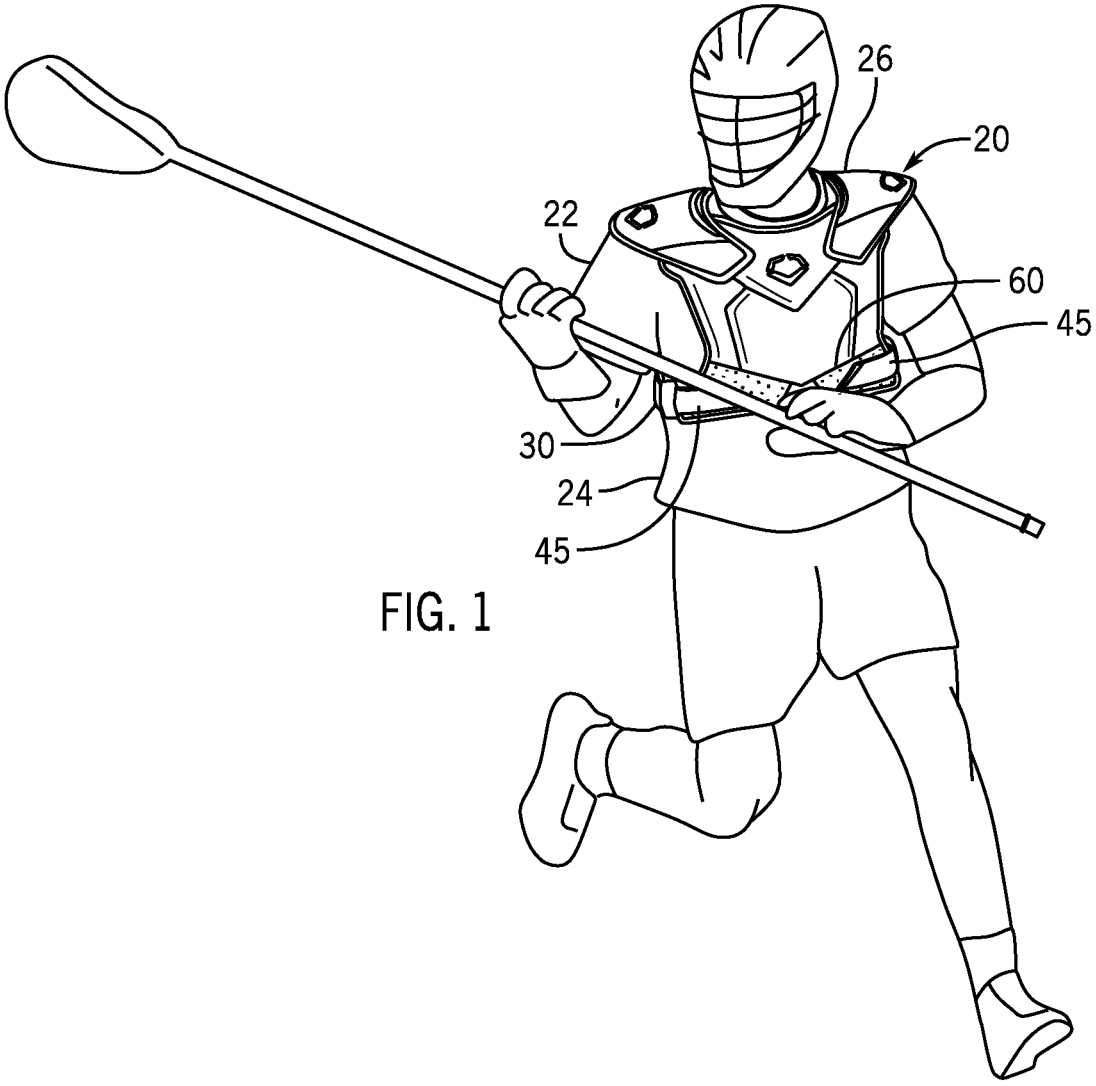
FIG. 1 is a perspective view of a sports participant wearing an example of sports upper body protective gear.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed is an example upper body protective gear that protects portions of the upper body of a sports participant during a sporting activity. The example sports protective gear may offer a snug fit and may better move in unison with the sport participant to provide enhanced protection and enhanced freedom of movement for the sports participant. Although the example sports upper body protective gear is disclosed for use in the sport of lacrosse, various features of the gear may likewise be adapted for use in other sporting activities such as football, baseball, softball, and the like.

In some implementations, the sports protective gear comprises shoulder portions that include shoulder pockets. The shoulder pockets removably receive moldable and hardenable protective insert panels. For example, the pockets may removably receive a panel including gel to shell technology, commercially available under the EVOSHIELD® brand name. The shape of each of the insert panels is moldable and customizable to match the contours of the individual sport participant's shoulder, providing a snug fit about the shoulders. In some implementations, the shoulder portions are provided as part of an outer upper body protector that includes a padded chest portion that also extends over a chest of the sports participant.

In some implementations, the sports protective gear comprises a shirt that is to be worn by the sports participant. The shirt may be fabric and may or may not include padding. The shirt comprises first and second side belt loops. The sports protective gear may further comprise an outer upper body protector that comprises a chest portion, a back portion and shoulder portions that extend between the chest portion and the back portion. First and second straps extend from the back portion, through the first and second side belt loops of the shirt, to the chest portion. The first and second straps may be elastic and/or may include a buckle, adjustable hook and loop fasteners or other tightening mechanisms that allow the chest portion and the back portion to be drawn towards one another and retained in a snug fit against the front, back and sides of the sports participant.

Figure 2:
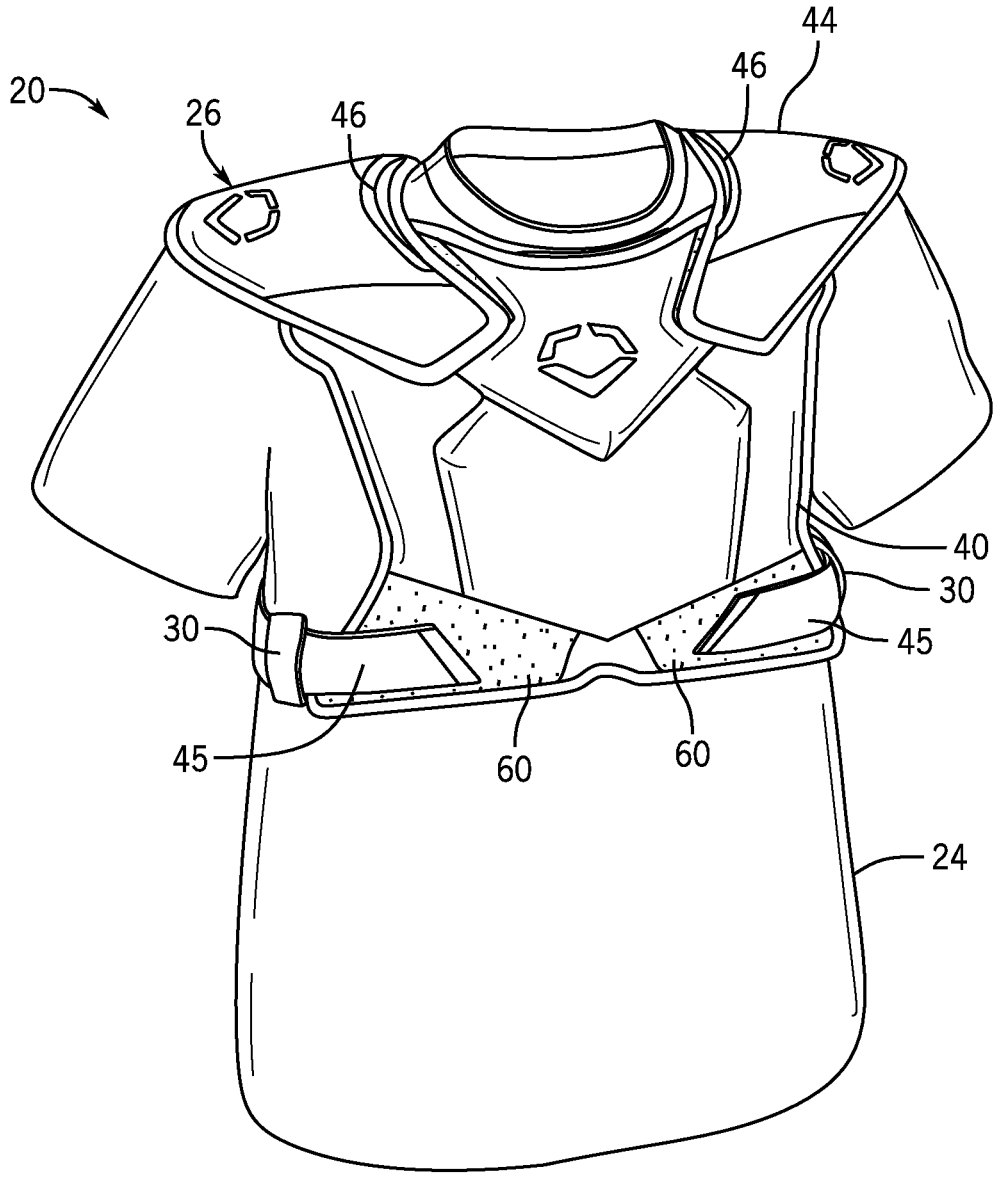
FIG. 2 is a front perspective view of the sports upper body protective gear of FIG. 1.
Figure 3:
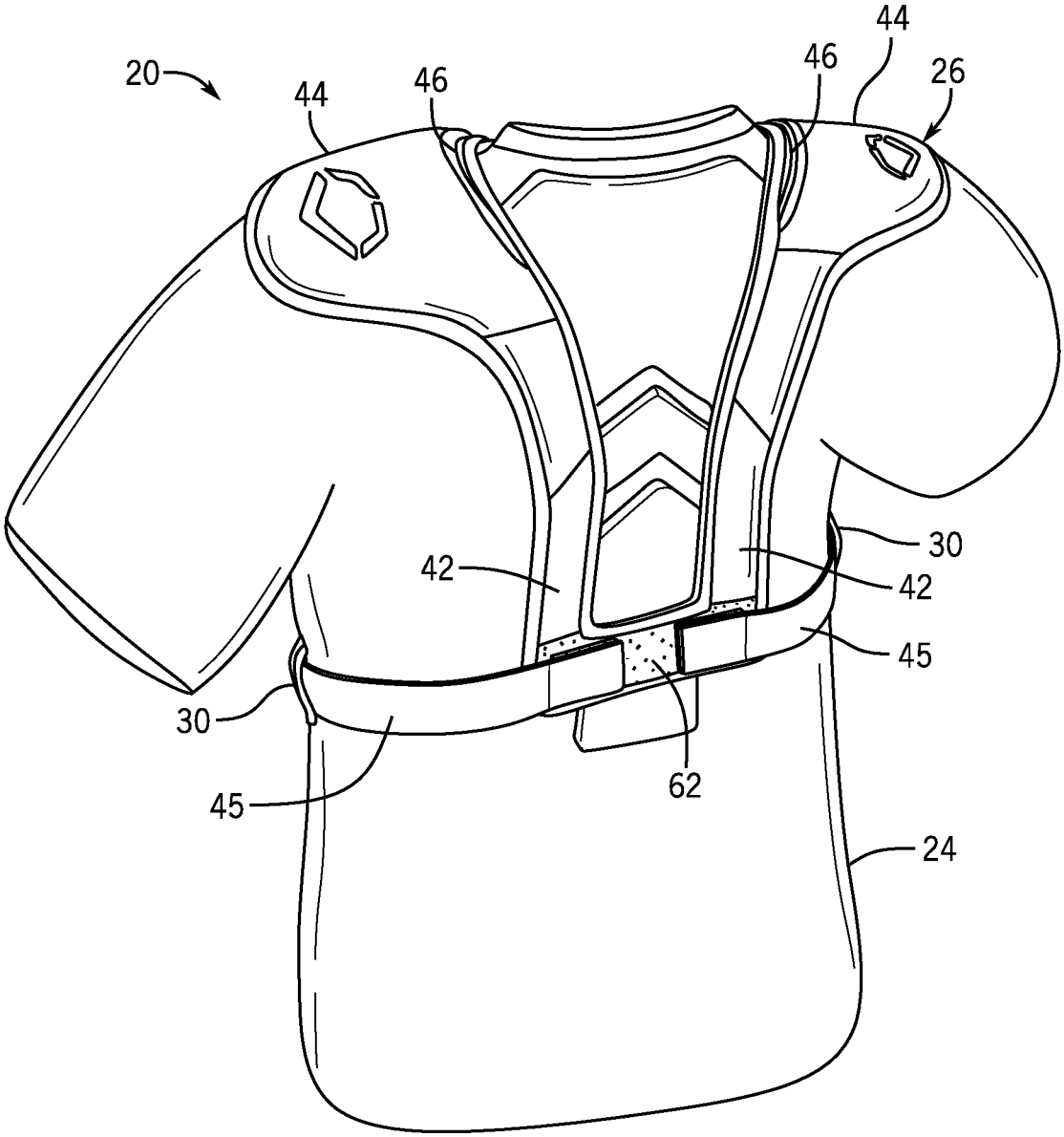
FIG. 3 is a rear perspective view of the sports upper body protective gear of FIG. 1.
Figure 4:
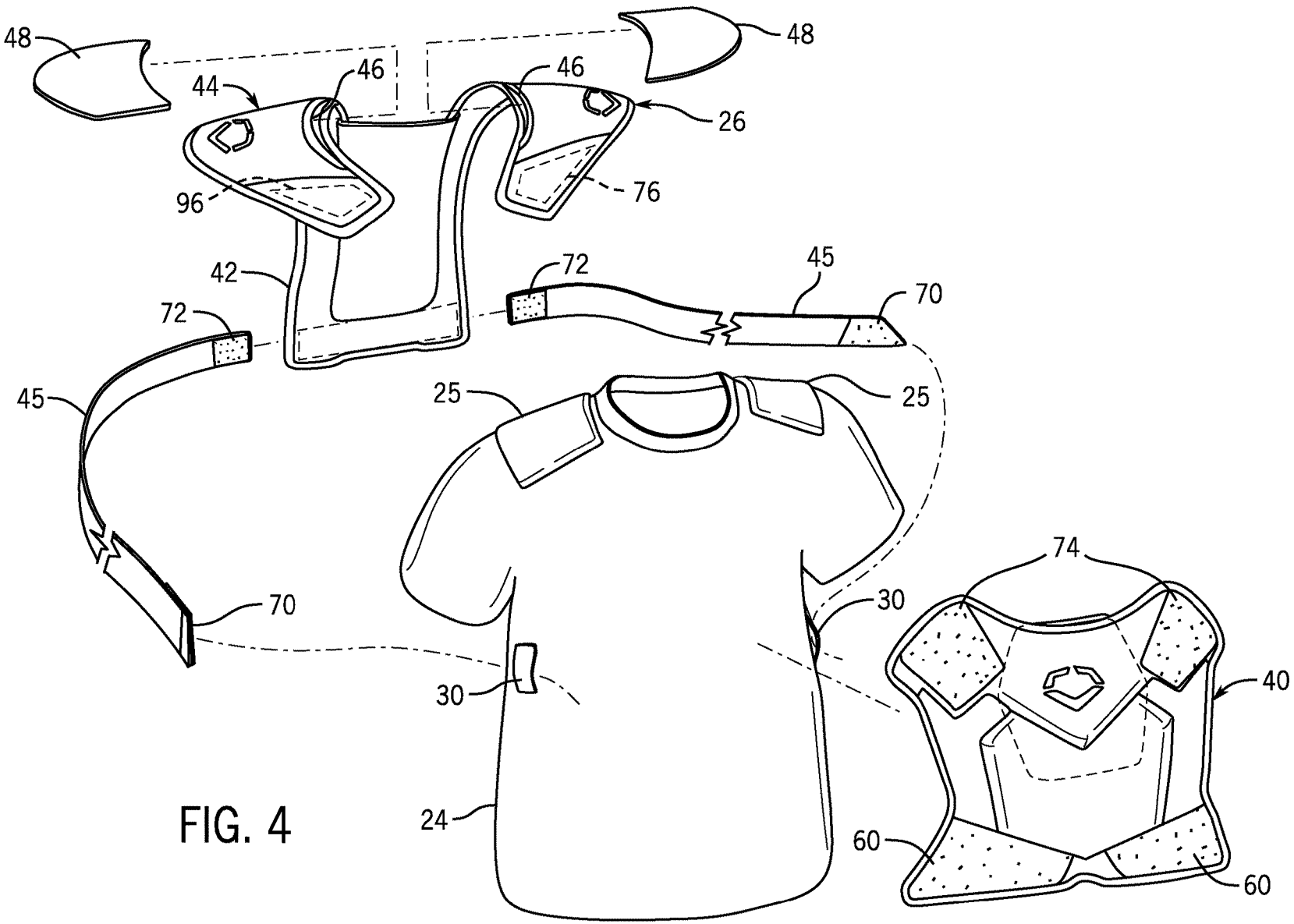
FIG. 4 is an exploded perspective view of the sports upper body protective gear of FIG. 1.
Figure 5:
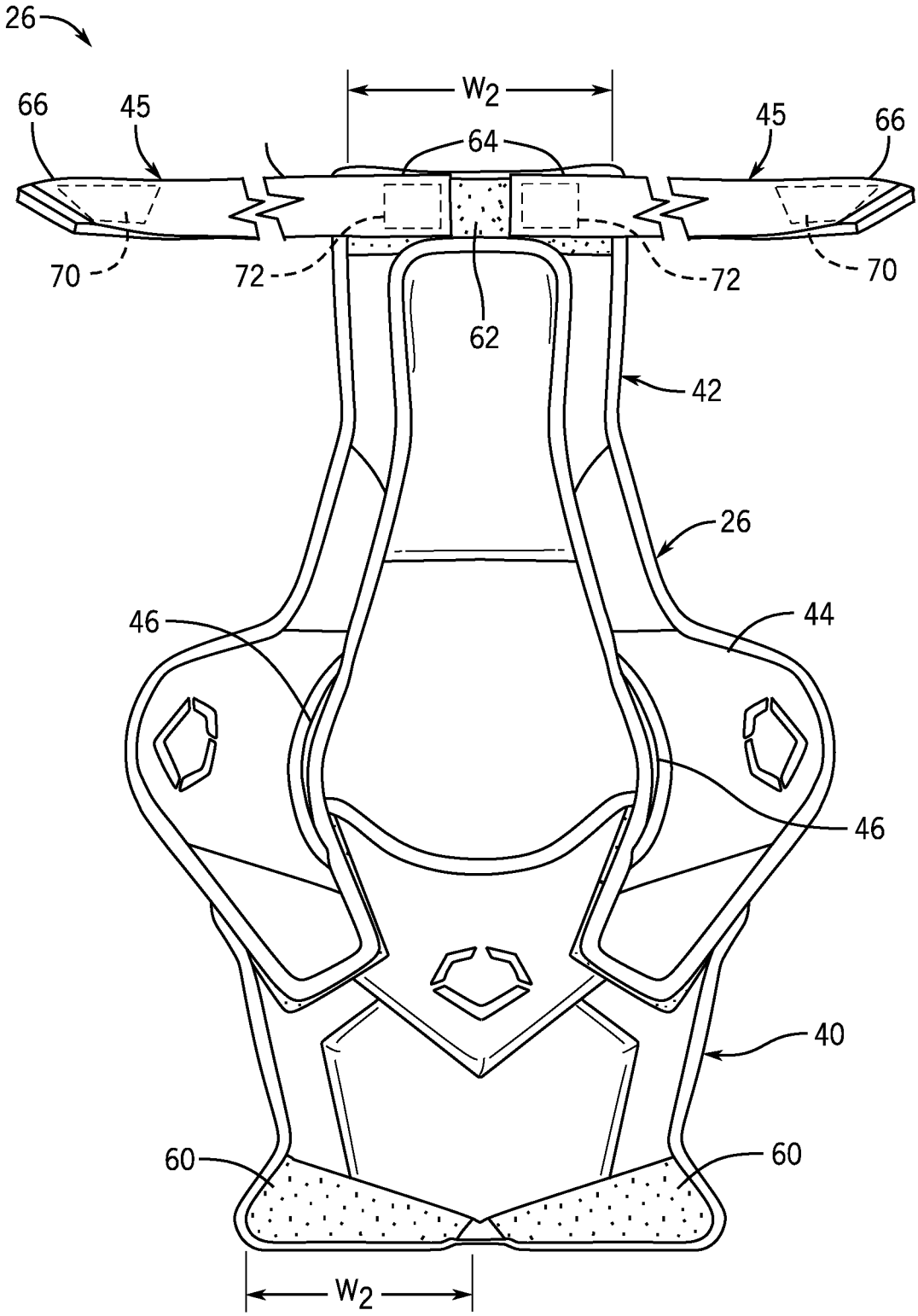
FIG. 5 is a top perspective view of an example upper body protector of the sports upper body protective gear of FIG. 1.

FIGS. 1-5 illustrate an example sports upper body protective gear 20. FIG. 1 is a perspective view of gear 20 being worn by sports participant 22. FIG. 2 is a front perspective view of the sports protective gear 20. FIG. 3 is a rear view of the sports protective gear 20. FIG. 4 is an exploded perspective view of the sports gear 20. FIG. 5 is a top view of the sports gear 20. The example sports protective gear 20 comprises shirt 24 and upper body protector 26.

Shirt 24 underlies upper body protector 26. Shirt 24 may be formed from a breathable fabric. In some implementations, shirt 24 may be formed from an elastic or resiliently stretchable material such as Lycra. In other implementations, other elastic or resiliently stretchable materials can be used. Shirt 24 closely conforms to the body of the sport participant 22. In the example illustrated, shirt 24 additionally comprises shoulder pads 25 which are stitched into the material of shirt 24 along the shoulders of shirt 24 or which are releasably joined the shoulders of shirt 24 by hook and loop fasteners or the like. In some implementations, shoulder pads 25 may be omitted.

Shirt 24 comprises first and second external belt loops 30 on opposite sides of shirt 24. As will be described hereafter, belt loops 30 are to receive straps that extend around the sides of the sport participant 22 so as to retain front and rear portions of upper body protector 26 in close conformity with the body of sport participant 22. Although shirt 24 is illustrated as comprising a single belt loop 30 on each opposing side, in other implementations, shirt 24 may comprise multiple belt loops on each side.

Upper body protector 26, sometimes referred to as shoulder pads, protects the chest and shoulders of the sport participant 22. Upper body protector 26 comprises a front chest portion 40, a rear or back portion 42, shoulder portions 44, and side straps 45. Chest portion 40 extends over a chest of the sport participant 22 and includes padding for protecting the chest of the sport participant 22.

Back portion 42 extends along the back of the sport participant 22. Shoulder portions 44 extend between chest portion 40 and back portion 42. As shown by FIGS. 4 and 7-12, shoulder portions 44 comprise mutually facing shoulder pockets 46 having mouths which are sized to removably receive moldable and hardenable protective insert panels 48. In some implementations, the mouths of shoulder pockets 46 are smaller than the corresponding dimensions of the protective insert panels 48, wherein the mouths are resiliently stretchable for reception of the protective insert panels 48 and for retention of the protective insert panels 48 once inserted into the pockets. In some implementations, the material forming the opposing sides of pockets 46 is also resiliently stretchable to assist in retaining protective insert panels 48. For example, the material forming the opposing sides of pockets 46 or forming the mouths of such pockets 46 may be formed from Lycra or other resiliently stretchable materials. In other implementations, the mouth of the pockets 46 can include one or more fasteners, such as a hook and loop fastener, one or more zippers, one or more buttons, one or more snap-fit connectors and combinations thereof.

Figure 10:
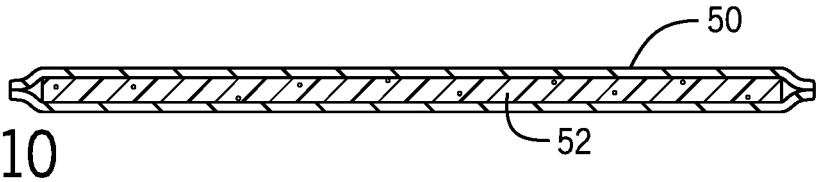
FIG. 10 is a sectional view of the example protective insert panel of FIG. 7 taken along line 10-10.

FIG. 10 is a sectional view of one of protective insert panels 48. As shown by FIG. 10, each of protective insert panels 48 comprises an outer covering 50 enclosing an internal moldable and hardenable interior panel 52. Outer covering 50 is pliable. Outer covering 50 may be fabric material or may be a polymeric material. Outer covering 50 encloses and contains interior panel 52.

Figure 11:
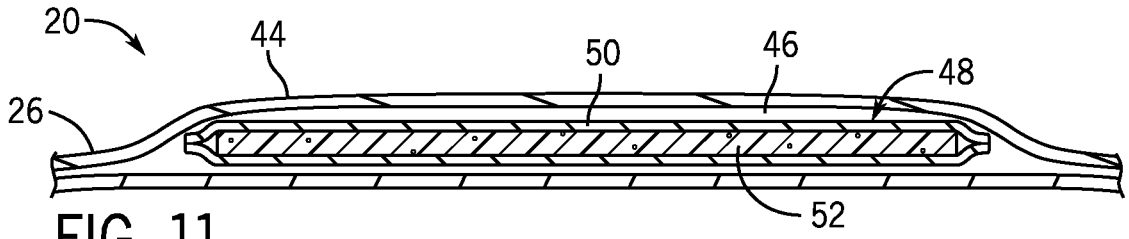
FIG. 11 is a cross-sectional view of the sports upper body protective gear of FIG. 8 taken along line 11-11.
Figure 12:
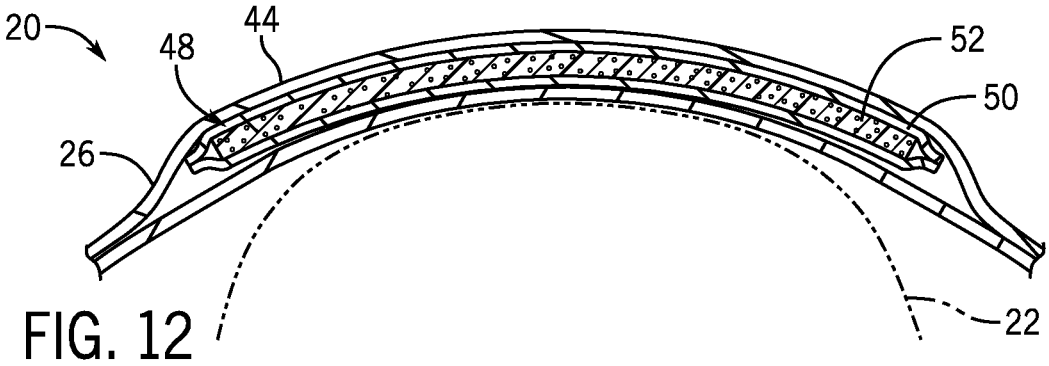
FIG. 12 is a cross-sectional view of the sports upper body protective gear of FIG. 9 taken along line 12-12.

Interior panel 52 is formed from a moldable and hardenable material such as a gel to shell material commercially available from EVOSHIELD®. As shown by FIG. 11, protective insert panel 48 may be inserted into pocket 46 prior to interior panel 52 being molded or hardened. As shown by FIG. 12, prior to being molded or hardened, protective insert panel 48 may be deformed to an arcuate shape corresponding to the arcuate surface of the shoulders of the sports participant 22. While being retained or held in the arcuate shape, interior panel 52 is allowed to harden to a rigid unchanging arcuate shape. In some implementations, each of protective insert panels 48 may be laid across the top of a sport participant's shoulder, deformed to match the contour of the sport participants shoulder, and hardened to such an arcuate shape prior to insertion into a respective pocket 46.

Referring to FIGS. 1-6, side straps 45 comprise bands of material that extend from back portion 42, through their associated side loops 30, and to chest portion 40. In one implementation, side straps 45 are formed from a fabric material. In some implementations, side straps 45 are formed from an elastic material. In other implementations, size as 45 are formed from an inelastic material. In some implementations, such as 45 are formed from nylon. In other implementations, side straps 45 may be formed from other materials.

Side straps 45 each have a portion that are connected to back portion 42 and chest portion 40. In the example illustrated, both end portions of each side straps 45 are releasably connected to chest portion 40 and back portion 42. In the example illustrated, as shown by FIGS. 2-6, both end portions of each of side chest 45 are releasably connected to chest portion 40 and back portion 42 by a hook and loop (VELCRO) fastening system. In particular, chest portion 40 comprises forward facing loop regions 60 while back portion 42 comprises rearwardly facing loop region or region 62. End portions 64 and 66 of straps 45 include hook regions 70 and hook regions 72, respectively. Hook regions 70 releasably connect to loop regions 60 while hook regions 72 releasably connect to hook regions 62. As should be appreciated, in other implementations, the location of the respective hook and loop regions may be reversed such as where regions 60 and 62 comprise hooks while regions 70 and 72 comprise loops.

In the example illustrated, regions 60 and 62 extend transversely across a majority of a width of just chest portion 40 and back portion 42, respectively. In the example illustrated, each of regions 60 have a width $W_1$ of at least 2 inches. Region 62 has a width $W_2$ of at least 3 inches. Because straps 45 are releasably connected at both ends to chest portion 40 and back portion 42 by hook and loop system, both end portion 64 and 66 of straps 45 may be releasably connected to back portion 42 and chest portion 40 at a continuum of possible transverse locations to provide a continuum of possible diameters about the torso of the sports participant to adjust for different sized torsos. Such an adjustment be quickly and easily achieved along both the front and the back of upper body protector 26. The adjustability along both chest portion 40 end back portion 42 increases the extent to which upper body protector 26 may be adjusted to accommodate different torso sizes.

In some implementations, end portion 64 and 66 may alternatively be releasably connected to back portion 42 and chest portion 40 using other connections such as snaps, buttons, hooks, clasps, and the like. In some implementations, chest portion 40 and back portion 42 may be provided with multiple snaps, buttons, hooks, clasps at multiple locations to provide multiple torso sizes for upper body protector 26. In some implementations, each of straps 45 may have one end that is free prior to being releasably connected to upper body protector 26 and another end which is fixed to upper body protector 26. For example, in some implementations, end portions 64 straps 45 may be fixed to back portion 42 with stitching, welding, or the like. In some implementations, end portions 66 may be fixed to chest portion 40 with stitching, welding on the like.

As shown by FIG. 4, the example back portion 42 and shoulder portions 44 are formed as a single unitary piece that is to extend along the back of the sport participant and over the shoulders of the sport participant. Just portion 40 is a separate piece that is to extend along the front chest of the sports participant. The two pieces are releasably connected to one another using a hook and loop (VELCRO) fastening system. In the example illustrated, chest portion 40 comprises loop regions 74 while shoulder portions 44 lower surface hook regions 76 which releasably lock to loop regions 74 to releasably secure shoulder portions 44 (and the integral back portion 42) to chest portion 40. In other implementations, shoulder portions 44 may be releasably connected to chest portion 40 using other releasable fastening or connection mechanism such as snaps, buttons, hooks, clasps, and the like. Because chest portion 40 is releasably connectable to shoulder portions 44 (and back portion 42), differently sized or configure chest portions 40 may be interchanged with differently sized or configured shoulder portions 44. As a result, upper body protector 26 may be adjusted to accommodate differently sized sports participants or to accommodate a sport participant as he or she grows or attains greater dimensions. In yet other implementations, shoulder portions 44 may be fixedly joined to or integrally formed as part of a single unitary body with chest portion 40 such as by welding, adhesives, stitching on the like. In some implementations, chest portion 40 and shoulder portions 44 may be integrally formed as a single unitary body out of a single continuous panel or layer of material.

Figure 6:
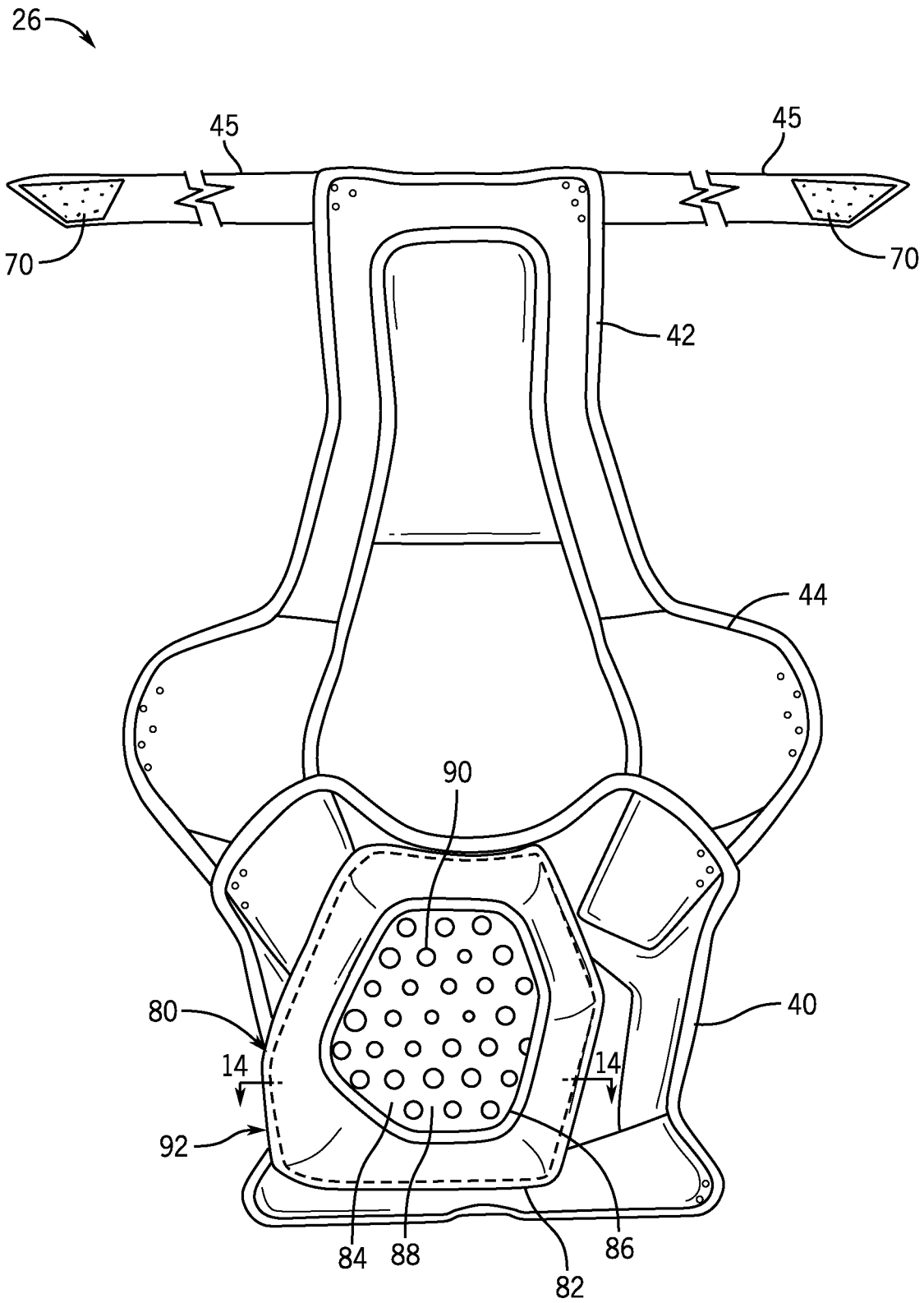
FIG. 6 is a bottom perspective view of the example upper body protector of FIG. 5.
Figure 7:
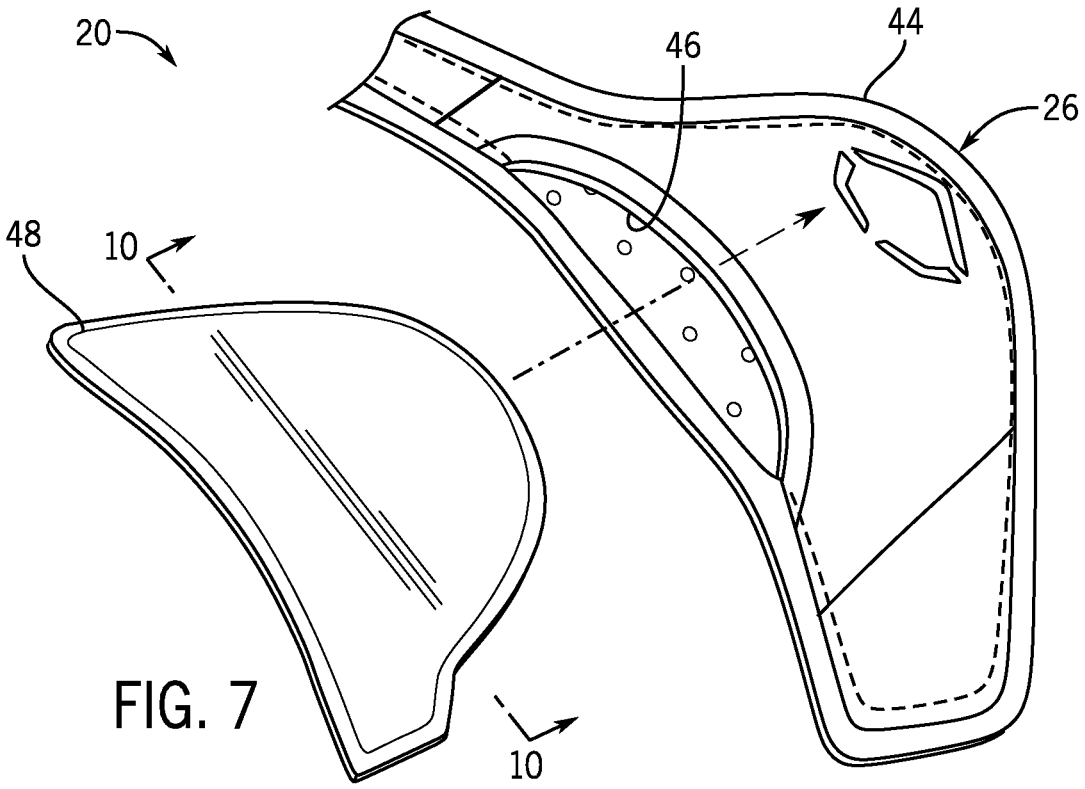
FIG. 7 is a fragmentary exploded view of the upper body protector of FIG. 5 with an example protective insert panel removed from an example shoulder pocket.
Figure 8:
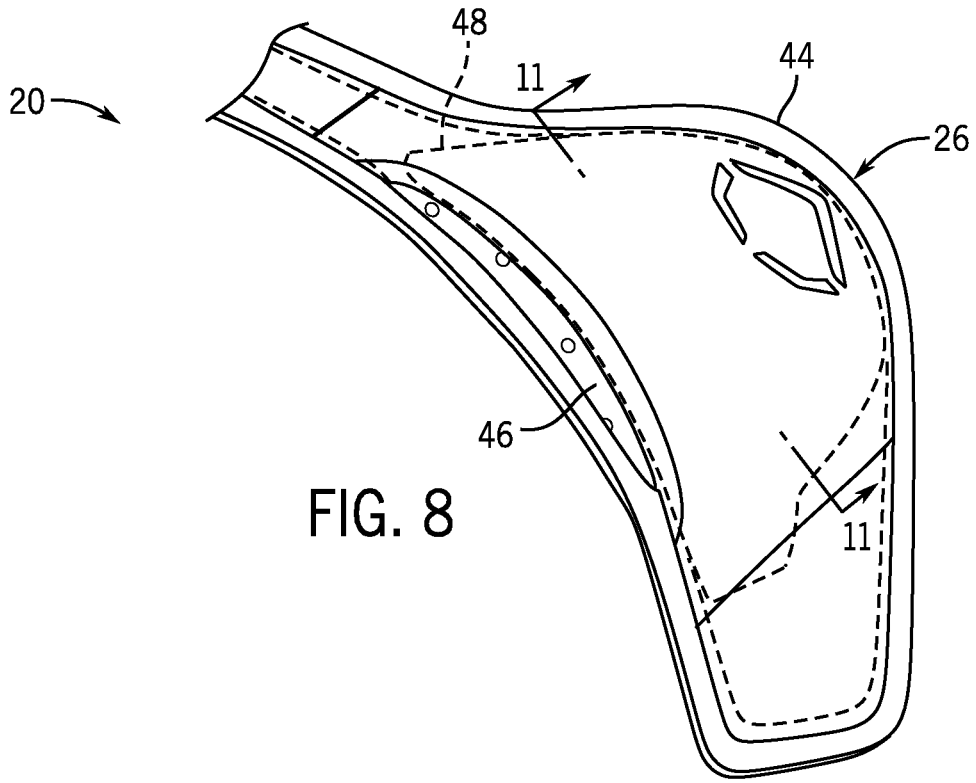
FIG. 8 is a fragmentary exploded view of the sports upper body protective gear of FIG. 5 with the example protective insert panel of FIG. 7 inserted into the example shoulder pocket.
Figure 9:
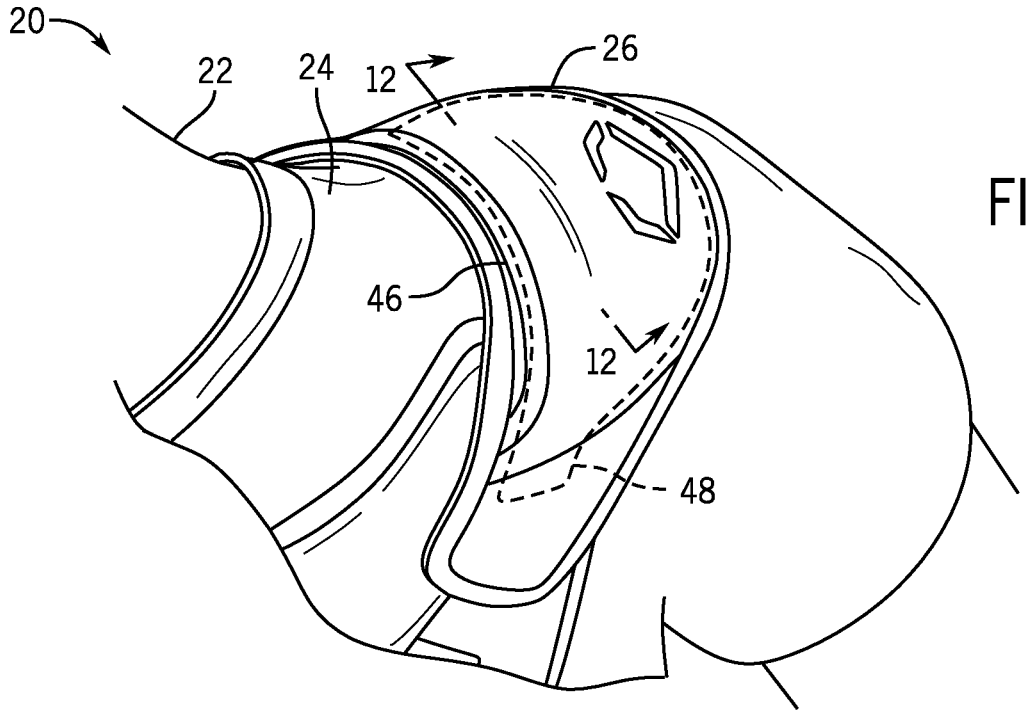
FIG. 9 is a fragmentary perspective view of the sports upper body protective gear being worn by a sport participant with the protective insert panel inserted into the example shoulder pocket.
Figure 13:
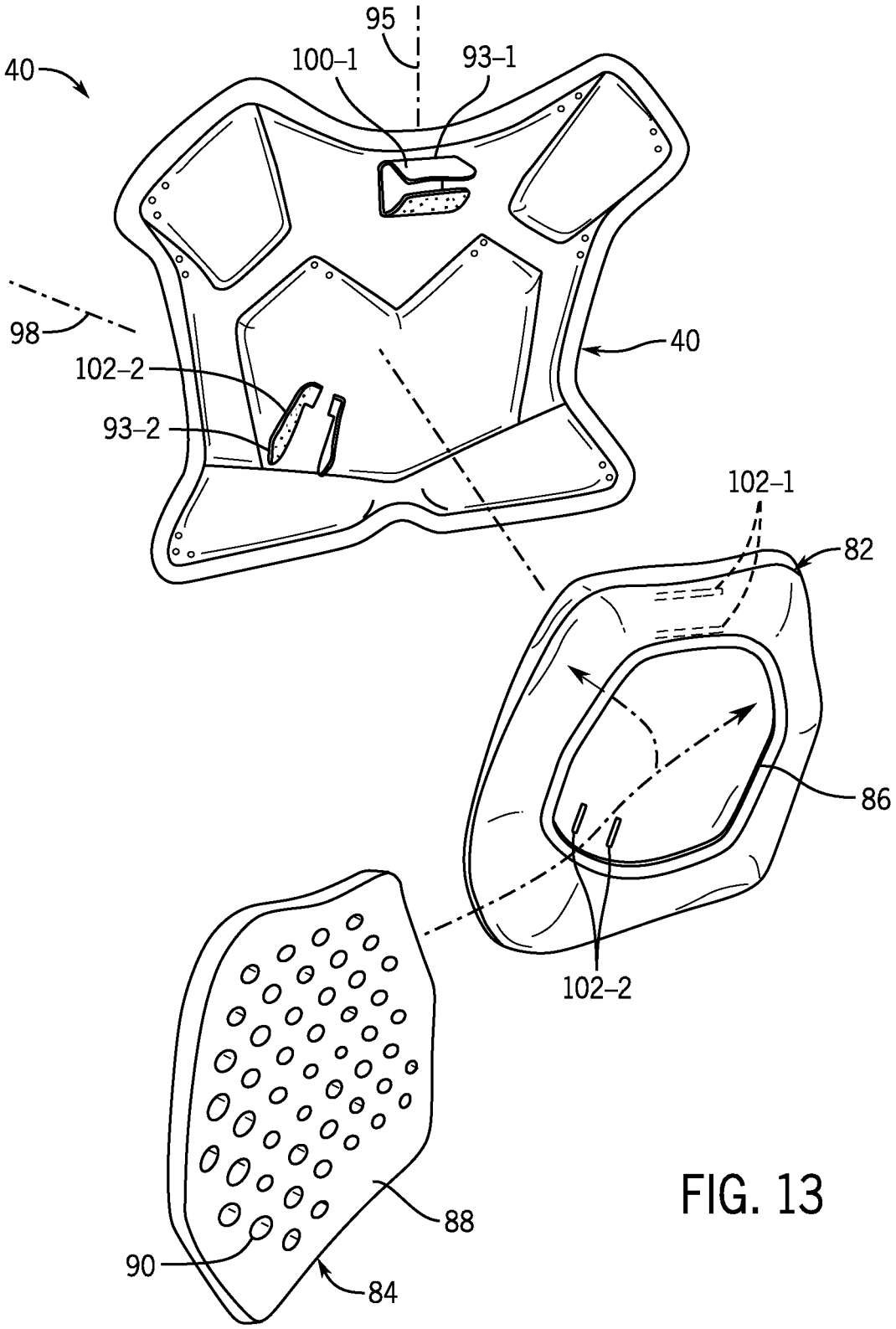
FIG. 13 is an exploded perspective view of an example chest portion of the example sports upper body protective gear of FIG. 1.
Figure 14:
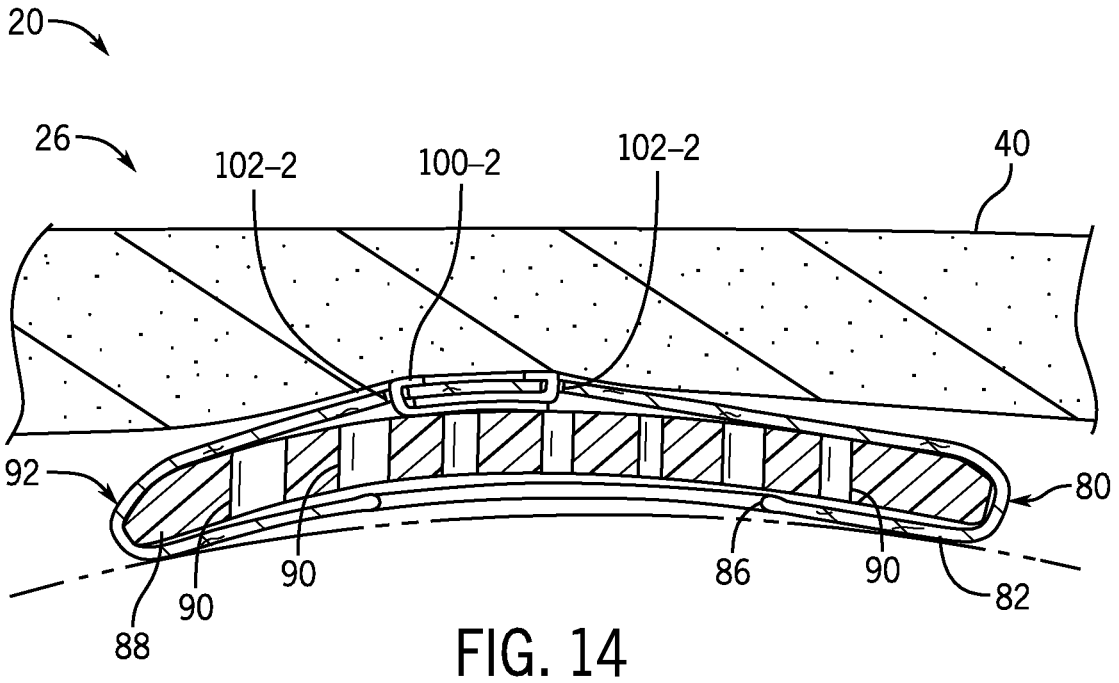
FIG. 14 is a sectional view of the sports upper body protective gear of FIG. 6 taken along line 14-14.

As shown by FIG. 6 and FIGS. 13-14, the example chest portion 40 of upper body protector 26 additionally comprises a heart protector in the form of a Commotio Cordis (CC) protection system 80. Commotio Cordis is a sometimes-lethal disruption of heart rhythm that occurs as a result of a blow to the area directly over the heart (the pre-cordial region) at a critical time during a heartbeat cycle. System 80 is configured to assist in reducing the likelihood of such a heart rhythm disruption by absorbing forces of an impact to the object the region of the chest portion 40.

System 80 comprises pouch 82 and CC protector 84. Pouch 82 comprises a bag or flexible receptacle sized to receive CC protector 84. Pouch 82 retains CC protector 84 in place between chest portion 40 and the chest of the sports participant. Pouch 82 further facilitates removal and exchange of CC protector 84. As a result, CC protector 84 may be replaced for repair or for an updated CC protector 84.

In the example illustrated, pouch 82 has a single mouth 86 through which CC protector 84 may be inserted into the interior or chest pocket of pouch 82. In some implementations, those portions about mouth 86 are formed from an elastic material, wherein mouth 86 may be stretched during insertion of CC protector 84 and elastically contracts upon insertion to retain CC protector 84 within the interior of pouch 82. In some implementations, additional portions of pouch 82 may be formed from an elastic or stretchable material. In some implementations, pouch 82 is formed from a breathable fabric to reduce excessive heat buildup.

CC protector 84 is removably inserted into pouch 82. CC protector 84 comprises a National Operating Committee on Standards for Athletic Equipment (NOCSAE) ND200 Commotio Cordis protector. In the example illustrated, CC protector 84 comprises a panel 88 formed from a compressible, shock absorbing material. In the example illustrated, panel 88 is perforated or honeycombed, including multiple openings 90 that extend completely through panel 88 from a front surface to a rear surface of panel 88. In the example illustrated, panel 88 has a thickness of at least 0.25 inch and no greater than 1 inch. In other implementations, CC protector 84 may have other sizes, shapes, and configurations so long as CC protector 84 complies with existing standards for such CC protection.

In the example illustrated, pouch 82 and CC protector 84 form a separate CC Protection module 92 that is releasably connected to an inner surface of chest portion 40 (the side of just portion 40 that faces or abuts the chest of the sports participant when worn). As a result, module 92 may be removed for repair or exchange. As a result, pouch 82 may be removed and cleaned or replaced. In certain applications, the pouch 82 and CC protector 84 may be not be necessary and may be removed as necessary.

In the example illustrated, pouch 82 is releasably connected to the inner surface of chest portion 40 by a pair of connectors 93-1 and 93-2 (collectively referred to as connectors 93). Connectors 93 have different orientations so as to limit movement of pouch 82 relative to chest portion 40 in different non-parallel directions. In the example illustrated, connector 93-1 limits movement of pouch 82 in a generally vertical direction along axis 96. Connector 93-2 limits movement of pouch 82 in a direction along a diagonal axis 98, at an angle oblique taxes 95, thereby limiting movement in a transverse direction, perpendicular to axis 95. As a result, pouch 82 and module 92 are securely retained in place.

In the example illustrated, connectors 93-1 and 93-2 comprise tightenable pouch securement straps 100-1 and 100-2 (collectively referred to as straps 100), respectively. Straps 100-1 and 100-2 are each sized and located so to pass through corresponding associated slits 102-1 and 102-2 formed in the pouch 82, respectively. The ends of straps 100 are releasably connected to one another to secure pouch 82 in place. In the example illustrated, the ends of straps 100 are releasably connected to one another using a hook and loop (VELCRO) fastening system. In other implementations, the opposite end portions of straps 100 may be released is secured to one another using other mechanisms such as buckles, snaps, class, and the like.

In other implementations, pouch 82 may be fixedly (permanently or non-releasably) joined to the inner surface of chest portion 40 by fasteners, stitching, adhesives, or the like. In some implementations, CC Protector 84 may be permanently contained within pouch 82, not removable from pouch 82. In some implementations, pouch 82 may be omitted such as where CC protector 84 is directly connected to the inner surface of chest portion 40. In such an implementation, CC protector 84 may be releasably connected directly to the inner surface of chest portion 40 or may be permanently flat fixedly connected directly to the inner surface of chest portion 40 such as with adhesives, welding, stitching or the like. In some implementations, CC protector 84 may be permanently or releasably contained within a pocket formed in and along the inner surface of chest portion 40. In some implementations, module 92 and/or CC protector 84 may be omitted.

The example sports upper body protective gear comprises four example features: (1) shoulder portions having shoulder pockets that removably receive moldable and hardenable protective insert panels; (2) a shirt in combination with straps that pass through belt loops in the shirt to conform the upper body protector to the sport participant; (3) a multi-piece assembly comprising a shoulder portion and a chest portion; and (4) a heart protector in the form of a CC protector removably received within a pouch carried by the chest portion. Although the example sports upper body protective gear is described as comprising each of the above features in combination with one another for overall enhanced performance, in other implementations, such features may be used independent of one another or in different combinations. For example, the above-described example shoulder portions with shoulder pockets and protective insert panels may be utilized on a single piece upper body protector or as part of sports upper body protective gear that omits the example shirt having belt loops and securement straps. The shoulder portion may be utilized with an upper body protector that omits the CC protector and its pouch. The above-described example CC protector and receiving pouch may be utilized on a single piece upper body protector with or without the above-described shirt and with or without the above-described shoulder pockets and protective insert panels. The above-described example shirt having belt loops and securement straps may be utilized with a single piece upper body protector, without the above-described example shoulder portions with shoulder pockets and protective insert panels and/or without the above-described example CC protector with its pouch.

Although the present disclosure has been described with reference to example implementations, workers skilled in the art will recognize that changes may be made in form and detail without departing from the disclosure. For example, although different example implementations may have been described as including features providing various benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. Sports upper body protective gear comprising:

a padded chest portion to extend over a chest of a sport participant; and shoulder portions extending from the padded chest portion over shoulders of the sport participant, each of the shoulder portions comprising a shoulder pocket to removably receive a moldable and hardenable protective insert panel;

a back portion extending from the shoulder portions to extend over a back of the sport participant;

a shirt to be worn by the sport participant beneath the padded chest portion and the shoulder portions, the shirt comprising first and second side belt loops; and first and second straps to extend from the back portion, through the first and second side belt loops, respectively, to the padded chest portion.

2. The sports upper body protective gear of claim 1, wherein the padded chest portion is releasably attached to the shoulder portions.

3. The sports upper body protective gear of claim 2 further comprising:

a pouch releasably attached to an inner surface of the padded chest portion, the pouch comprising a chest pocket to removably receive a National Operating Committee on Standards for Athletic Equipment (NOCSAE) ND200 Commotio Cordis protector.

4. The sports upper body protective gear of claim 3 further comprising a tightenable pouch securement strap releasably attaching the pouch to the inner surface of the padded chest portion.

5. The sports upper body protective gear of claim 4, wherein the pouch securement strap comprises portions of a hook and loop fastening system on opposite end portions of the pouch securement strap.

6. The sports upper body protective gear of claim 5, wherein the pouch comprises a pair of slits through which the pouch securement strap extends.

7. The sports upper body protective gear of claim 3, wherein the pouch is releasably attached to the inner surface of the padded chest portion by two connectors, each of the two connectors having a different orientation to limit movement of the pouch relative to the padded chest portion in different non-parallel directions.

8. Sports upper body protective gear comprising:

a shirt to be worn by a sport participant, the shirt comprising first and second side belt loops;

an upper body protector comprising:

a chest portion to extend over a chest of the sport participant and over the shirt;

a back portion to extend over a back of the sport participant;

shoulder portions extending between the chest portion and the back portion, over shoulders of the sport participant and over the shirt; and first and second straps extending from the back portion, through the first and second side belt loops, respectively, to the chest portion.

9. The sports upper body protective gear of claim 8, wherein the padded chest portion is releasably attached to the shoulder portions.

10. The sports upper body protective gear of claim 9 further comprising:

a pouch releasably attached to an inner surface of the chest portion, the pouch comprising a chest pocket to removably receive a National Operating Committee on Standards for Athletic Equipment (NOCSAE) ND200 Commotio Cordis protector.

11. The sports upper body protective gear of claim 10 further comprising a tightenable pouch securement strap releasably attaching the pouch to the inner surface of the padded chest portion.

12. The sports upper body protective gear of claim 11, wherein the pouch securement strap comprises portions of a hook and loop fastening system on opposite end portions of the pouch securement strap.

13. The sports upper body protective gear of claim 12, wherein the pouch comprises a pair of slits through which the pouch securement strap extends.

14. The sports upper body protective gear of claim 10, wherein the pouch is releasably attached to the inner surface of the padded chest portion by two connectors, each of the two connectors having a different orientation to limit movement of the pouch relative to the padded chest portion in different non-parallel directions.

15. Sports upper body protective gear comprising:

a padded chest portion to extend over a chest of a sport participant; and a pouch releasably attached to an inner surface of the padded chest portion, the pouch comprising a chest pocket to removably receive a National Operating Committee on Standards for Athletic Equipment (NOCSAE) ND200 Commotio Cordis protector.

16. The sports upper body protective gear of claim 15 further comprising a tightenable pouch securement strap releasably attaching the pouch to the inner surface of the padded chest portion.

17. The sports upper body protective gear of claim 16, wherein the pouch securement strap comprises portions of a hook and loop fastening system on opposite end portions of the pouch securement strap.

18. The sports upper body protective gear of claim 17, wherein the pouch comprises a pair of slits through which the pouch securement strap extends.

19. The sports upper body protective gear of claim 15, wherein the pouch is releasably attached to the inner surface of the padded chest portion by two connectors, each of the two connectors having a different orientation to limit movement of the pouch relative to the padded chest portion in different non-parallel directions.

20. The sports upper body protective gear of claim 1 further comprising the moldable and hardenable protective insert panel, wherein the moldable and hardenable protective insert panel is hardenable to a rigid unchanging arcuate shape after being molded and deformed to the arcuate shape.

21. The sports upper body protective gear of claim 8, wherein the back portion, the padded chest portion and the shoulder portions form an upper body protector positioned over the shirt, wherein the first and second straps each have end portions connected to the upper body protector and wherein the shirt comprises:

a shirt back portion underlying the back portion of the upper body protector;

shirt shoulder portions underlying the shoulder portions of the upper body protector; and a shirt chest portion underlying the padded chest portion of the upper body protector.

* * * * *